US006959648B2

(12) United States Patent
Piela

(10) Patent No.: US 6,959,648 B2
(45) Date of Patent: Nov. 1, 2005

(54) AMMUNITION CARTRIDGE

(75) Inventor: Michael John Piela, Birmingham (GB)

(73) Assignee: Eley Limited (GB)

( * ) Notice: Subject to any disclaimer, the term of this patent is extended or adjusted under 35 U.S.C. 154(b) by 0 days.

(21) Appl. No.: 10/250,728

(22) PCT Filed: Jan. 9, 2002

(86) PCT No.: PCT/GB02/00057

§ 371 (c)(1),
(2), (4) Date: Jul. 8, 2003

(87) PCT Pub. No.: WO02/055955

PCT Pub. Date: Jul. 18, 2002

(65) Prior Publication Data

US 2004/0050284 A1 Mar. 18, 2004

(30) Foreign Application Priority Data

Jan. 9, 2001 (GB) ..... 0100578

(51) Int. Cl.[7] ..... F42B 10/00
(52) U.S. Cl. ..... 102/511
(58) Field of Search ..... 102/511, 529

(56) References Cited

U.S. PATENT DOCUMENTS

| | | | | | |
|---|---|---|---|---|---|
| 1,293,431 | A | * | 2/1919 | Herman | 102/511 |
| 1,426,907 | A | * | 8/1922 | Ramsey | 102/511 |
| 1,481,930 | A | * | 1/1924 | Schneider | 102/511 |
| 3,672,304 | A | | 6/1972 | Rogers et al. | |
| 4,208,968 | A | * | 6/1980 | Hubsch et al. | 102/513 |
| 4,228,973 | A | | 10/1980 | Klein | |
| 5,069,139 | A | * | 12/1991 | Denis | 102/518 |
| 5,275,108 | A | * | 1/1994 | Chernicky et al. | 102/439 |

FOREIGN PATENT DOCUMENTS

| | | | | | |
|---|---|---|---|---|---|
| DE | 27 06 886 | A1 | * | 8/1978 | 102/529 |
| GB | 531389 | A | | 1/1941 | |
| GB | 2105444 | A | | 3/1983 | |
| GB | 2 105 444 | A | * | 3/1983 | 102/529 |
| WO | WO 92 03693 | A | | 3/1992 | |

* cited by examiner

*Primary Examiner*—Stephen M. Johnson
(74) *Attorney, Agent, or Firm*—Wallenstein Wagner & Rockey, Ltd.

(57) ABSTRACT

An ammunition cartridge having a bullet with a curved front end terminating in a flat nose normal to the longitudinal axis of the bullet and a casing attached to the rear end of the bullet is disclosed. The nose is provided with a centrally disposed projection and a reservoir of lubricant around the projection.

10 Claims, 5 Drawing Sheets

Fig. 1 [PRIOR ART]

AMMUNITION CARTRIDGE

CROSS-REFERENCE TO RELATED APPLICATIONS

This Application is a U.S. National filing under §371 of International Application No. PCT/GB02/00057, filed 9 Jan. 2002, claiming priority from British Appln. No. 0100578.4, filed 9 Jan. 2001, now pending (which is hereby incorporated by reference).

FIELD OF THE INVENTION

This invention relates to ammunition cartridges. It is particularly concerned with target and sporting ammunition, especially rimfire .22 ammunition, and will be more specifically described below with reference to .22 ammunition cartridges, although it will be appreciated that it is not intended to be limited thereto.

BACKGROUND OF THE INVENTION

Conventionally, .22 rimfire ammunition cartridges comprise a cylindrical casing closed at one end and open at the other, the open end being crimped to a bullet, usually of lead. The closed end or head of the casing defines an annular flange or rim containing a priming composition which ignites by a rimfire strike and the hollow body of the casing contains a propellant which is fired by the ignition of the primer causing rapid expansion of hot gases to force the bullet from its seating.

The bullet conventionally has a cylindrical body portion, which may be solid or hollow and a tapered, curved, or so-called ogive, portion leading from the cylindrical body to the nose of the bullet. The body portion usually has external knurls to hold lubricant which is provided to prevent material being stripped from the circumference of the bullet as it is expelled along the barrel of the gun.

It has previously been proposed, see for example, U.S. Pat. No. 3,866,536, to provide a flat nose on a bullet so that the ogive curve is in effect shortened and cut off at the nose end.

SUMMARY OF THE INVENTION

It is an object of the invention to provide an improved bullet shape to provide greater accuracy and consistency.

Accordingly, in one aspect, the invention provides an ammunition cartridge comprising a casing attached to a bullet, the bullet having a body portion of generally cylindrical shape, one end of which is attached to the casing and the other end of which has a tapering curved portion, the curved portion ending in a flat nose normal to the longitudinal axis of the bullet and the flat nose having a centrally-disposed projection in the direction of the longitudinal axis.

In another aspect the invention also provides a bullet having the shape described in the immediately preceding paragraph.

The projection from the flat nose of the bullet is preferably circular in plan, although this is not essential. The projection is preferably uniformly disposed about the longitudinal axis of the bullet to provide an even weight distribution and it could, if desired, be for example of square configuration in plan.

Where the projection is circular in plan, it may be of cylindrical configuration so as to have a flat outer end or it may be domed so as to have a curved outer end.

In a yet further aspect, the invention provides an apparatus for the manufacture of a bullet, the apparatus comprising a die, a first part of which defines a cylindrical cavity to receive the material to form the bullet, and two punch parts, one located at each end of the cavity whereby the material may be compressed in the cavity between the punch parts, the first part of the punch being shaped to define the rear portion of the bullet which is to be attached to a casing and the second part of the punch being shaped to have a hollow portion defining the curved portion and nose of the bullet, the curved portion ending in a flat face with a recess extending from the flat face to define a nose projection of the bullet.

In a conventional bullet press, the surface defining the cavity in which the bullet is formed between the two punch parts has a narrow sprue passageway leading into the cavity. The bullet is, therefore, formed with a sprue usually at right angles to its longitudinally extending body.

In the apparatus of the present invention, however, it is preferred that the sprue passageway be provided in the second part of the punch, extending from the recess which defines the nose projection in the general direction of the longitudinal axis of the bullet. If this sprue passageway extends completely through the second part of the punch, i.e. vents through the punch, we have found that improved bullet shape and uniformity with greater conformity to the final desired shape can be obtained.

In a still further aspect, the invention provides a method of manufacturing a bullet, the method comprising providing material to form the bullet, shaping the material to form the bullet characterised in that a front end of the bullet is formed with a centrally disposed projection extending from a flat nose in the direction of the longitudinal axis of the bullet.

Preferably, the method includes forming a reservoir of lubricant on the nose around the projection.

We have surprisingly found that the novel bullet shape of the invention can provide increased accuracy and consistency. Although not wishing to be limited to any particular theory, it is believed that one reason for the improvement over conventional bullet shapes is to do with the lubrication of the bullet. Bullets of the invention are coated as is conventional by coating with a liquid lubricant which is allowed to set on the outer surface of the bullet. The bullet may have conventional knurling on its cylindrical outer surface to provide reservoirs of the lubricant but we have found that an additional reservoir of lubricant can be provided during the coating process at the bullet nose around the base of the projection from the flat surface. This further reservoir can provide an extra degree of lubrication on firing of the ammunition so that the bullet surface is better protected as it travel along the barrel.

It is also believed that the bullet shape of the invention provides an improved relationship between the centre of gravity and the centre of pressure of the bullet. The centre of gravity normally lies within the cylindrical body portion of the bullet. The centre of pressure lies within the curved portion of the bullet and is the notional point where, when the bullet is fired, the lines of pressure normal to all points on the outer ogive surface meet inside the bullet. The centre of pressure in a bullet of the invention is moved further away from the centre of gravity, which is believed to improve balance and ballistic accuracy.

Embodiments of the invention will now be described by way of example only with reference to the accompanying drawings in which: drawings.

DETAILED DESCRIPTION OF EXEMPLARY EMBODIMENTS

Figure 1:
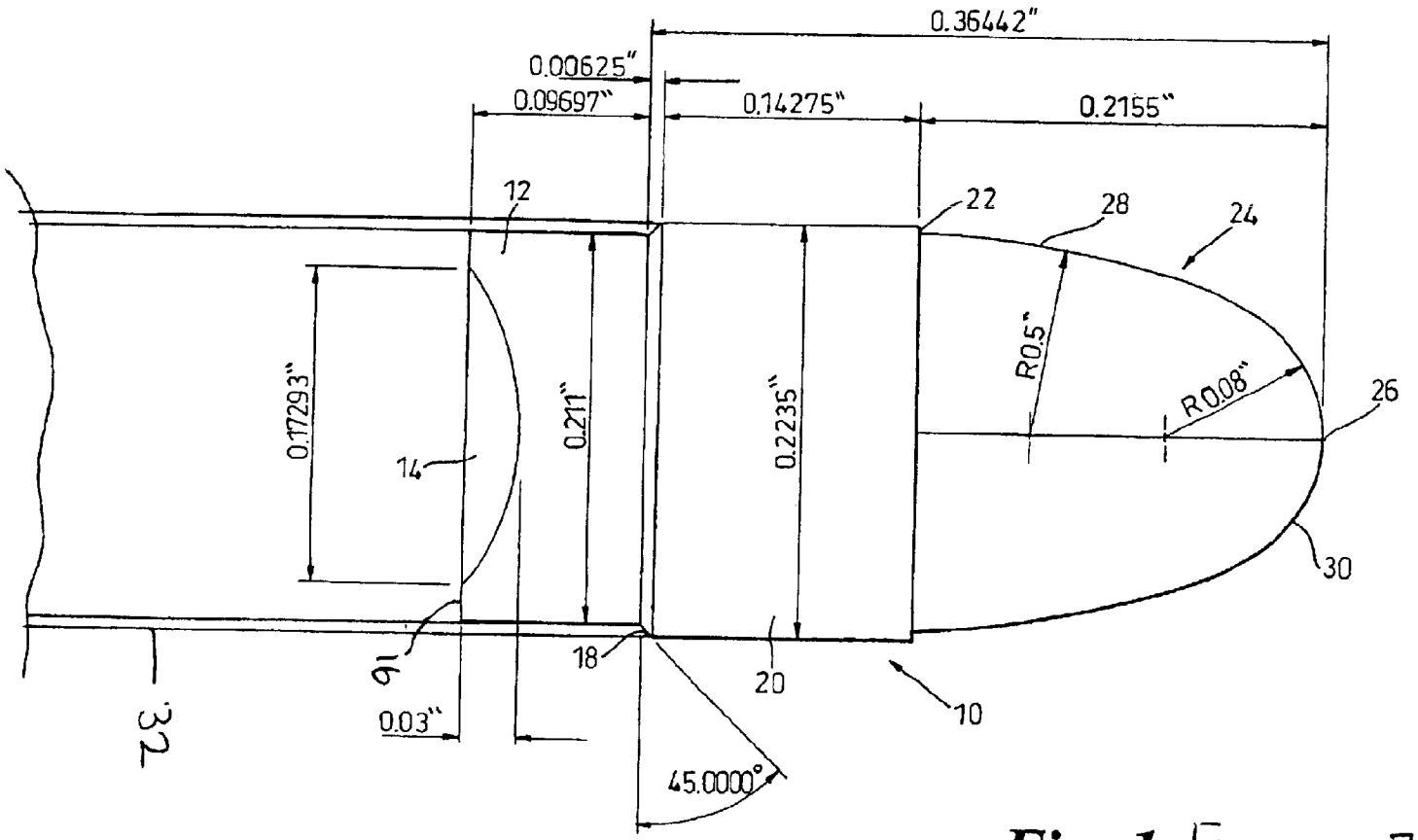
FIG. 1 shows a conventional TENEX gullet, which is a high quality .22 rifle bullet.

In FIG. 1 a conventional .22 bullet 10 has a rear cylindrical heel portion 12 with a concave cavity 14 in its rear face 16. A step 18 leads from the front of heel portion 12 to a slightly larger diameter cylindrical central body portion 20. At the front of the body portion 20 a step 22 leads to the tapered curved or ogive portion 24 at the front of which is the nose 26.

It will be seen that the ogive portion 24 has a double curvature with a first region 28 extending from the body portion having a much greater radius than the front region 30 leading to the nose.

To form the desired 0.22 cartridge a metal casing 32 will be crimped to the heel portion 12 and then the bullet is coated with a suitable lubricant. The coating and crimping techniques are well known in the art.

Figure 2:
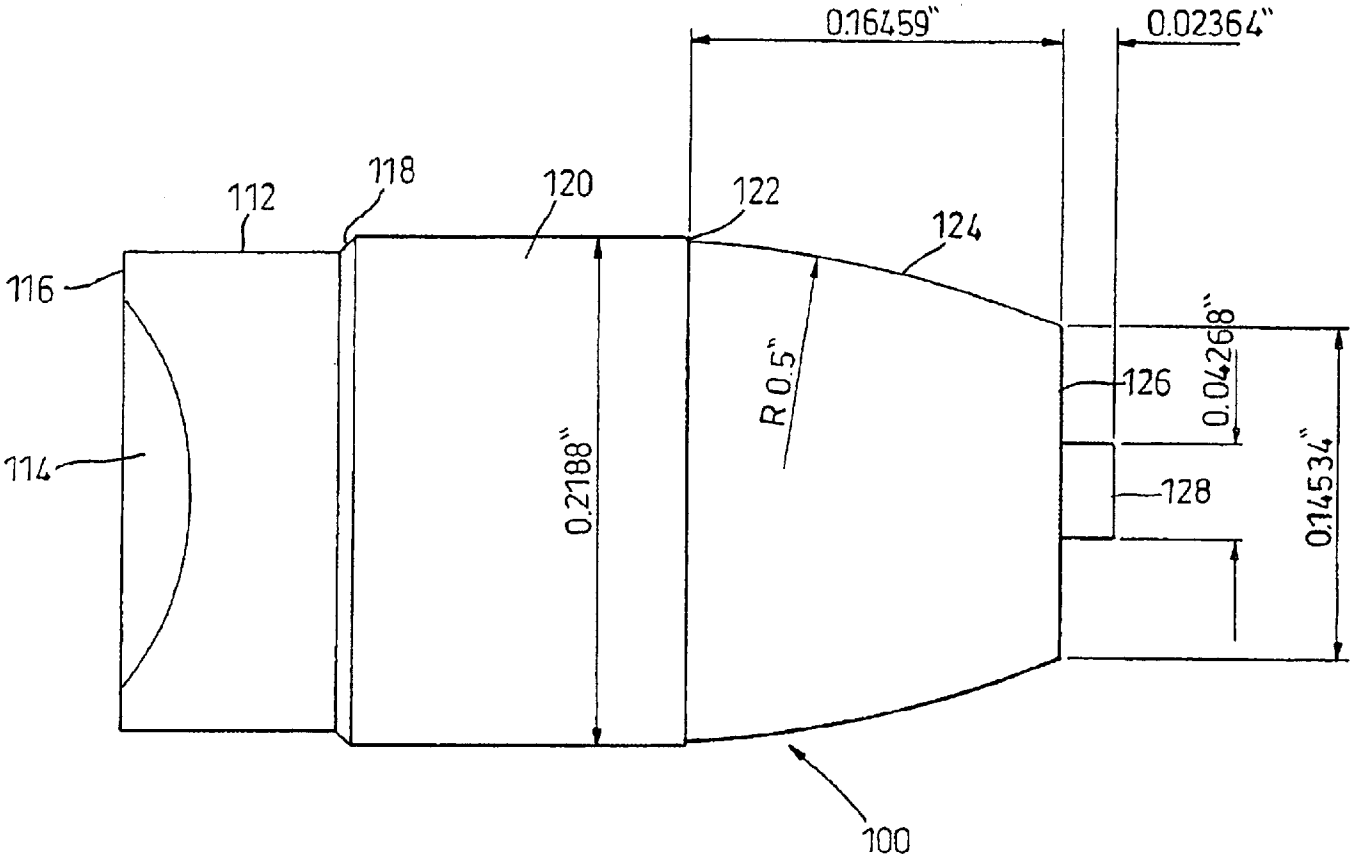
FIG. 2 shows a first bullet of the invention.

In FIG. 2 is shown a first bullet 100 of the invention.

This has a rear cylindrical heel portion 112 similar to the heel portion of the bullet 10 of FIG. 1. Heel portion 112 has a concave cavity 114 in its rear face 116. A step 118 leads to cylindrical central body portion 120 and a step 122 leads to a tapering curved front portion 124. Portion 124 is of a single curvature and ends in a flat nose 126. A central cylindrical projection 128 extends forwardly from flat nose 126.

Figure 3:
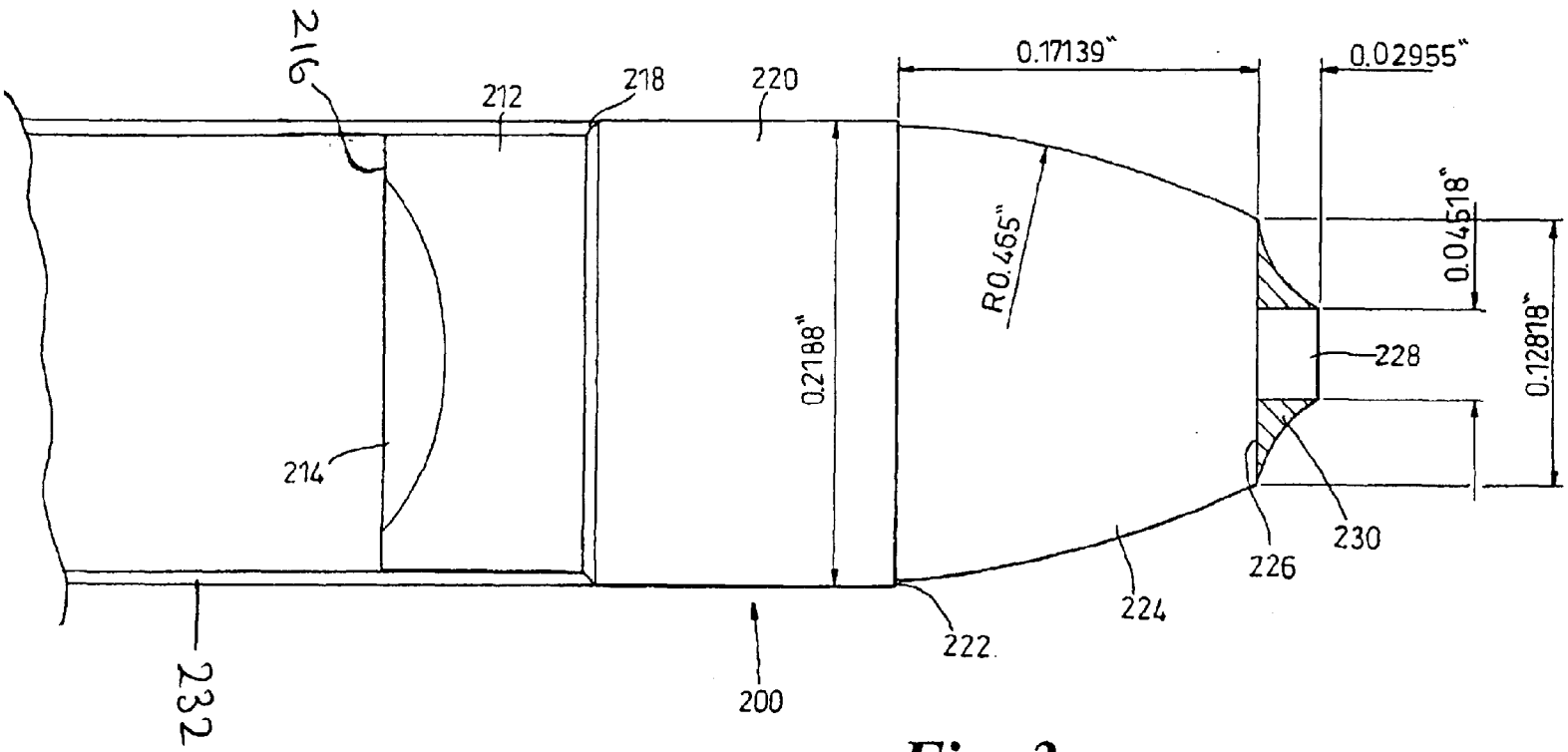
FIG. 3 shows a second bullet of the invention.

In FIG. 3 is shown a second bullet 200 of the invention.

Again this has a rear cylindrical heel portion 212 with a concave cavity 214 in its rear face 216 and attached to a casing 232. A step 218 leads to cylindrical central body portion 220 and a step 222 leads to a tapering curved front portion 224. As with the bullet of FIG. 2, the front portion 224 is of a single curvature and ends in a flat nose 226. A central cylindrical projection 228 extends forwardly from flat nose 226.

In this embodiment the bullet 200 is shown after it has been coated with lubricant. As shown, a "reservoir" 230 of lubricant has collected and set around nose projection 228. This reservoir provides additional lubrication as it can be forced to flow along the exterior of the bullet as it is fired through a gun barrel.

Figure 4:
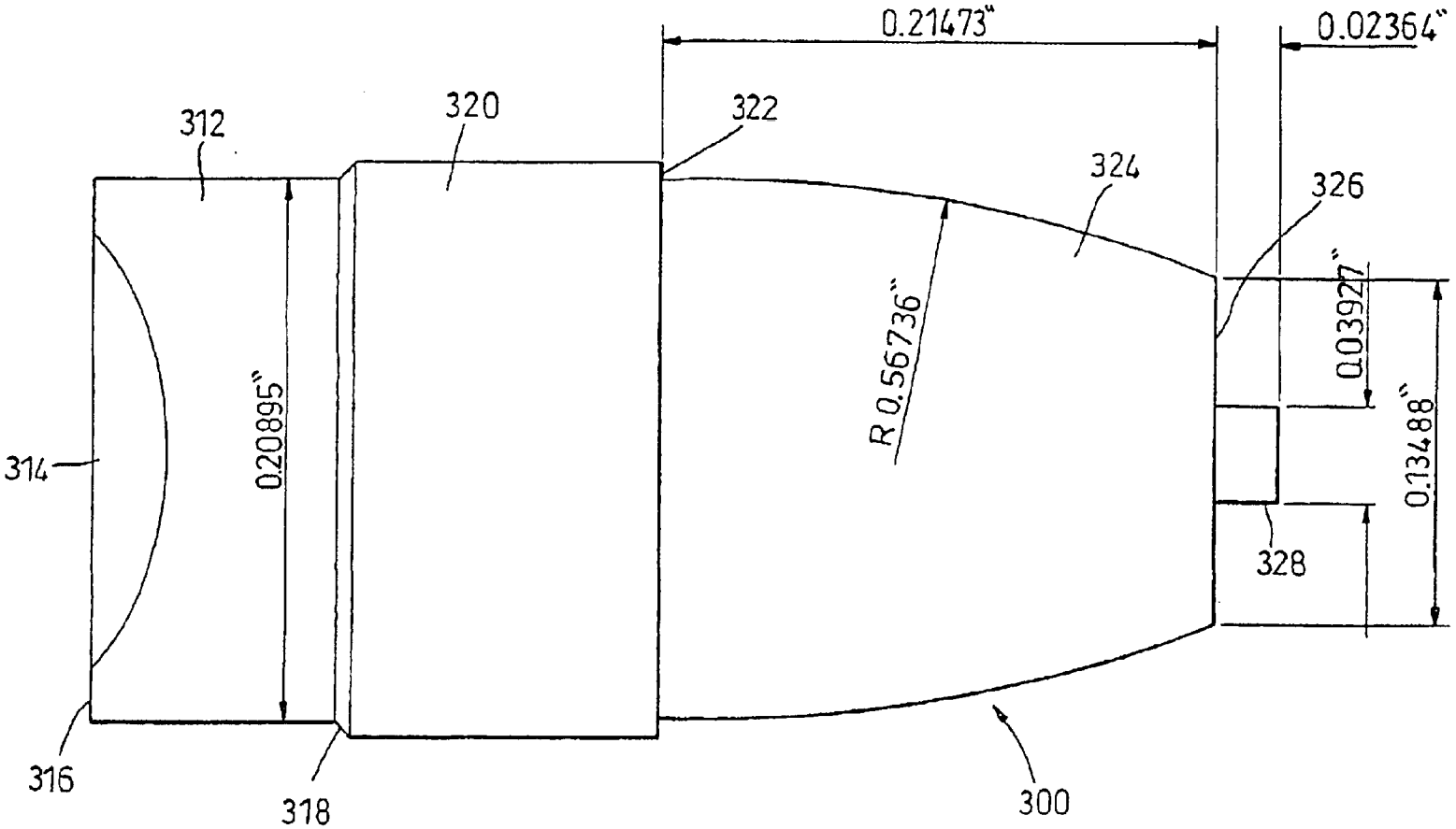
FIG. 4 shows a third bullet of the invention.

In FIG. 4 is shown a third bullet 300 of the invention.

Again it has a rear heel portion 312 with a concave cavity 314 in its rear face 316. A step 318 leads to cylindrical central body portion 320 and a further step 322 leads to a tapering curved front portion 324. Portion 324 is again of a single curvature which ends in a flat nose 326. Nose 326 has a centrally disposed cylindrical projection 328.

It will be appreciated that the embodiments shown and described above are for exemplification of the invention only. The dimensions and radii indicated may be varied widely and may readily be adapted for bullets other than .22 calibre.

The projections from the flat nose need not be cylindrical and may, for example, as indicated above, be square in plan or domed.

The central body portion of the bullets will normally have conventional knurled regions applied to them to provide the usual reservoirs for lubricant.

Figure 5:
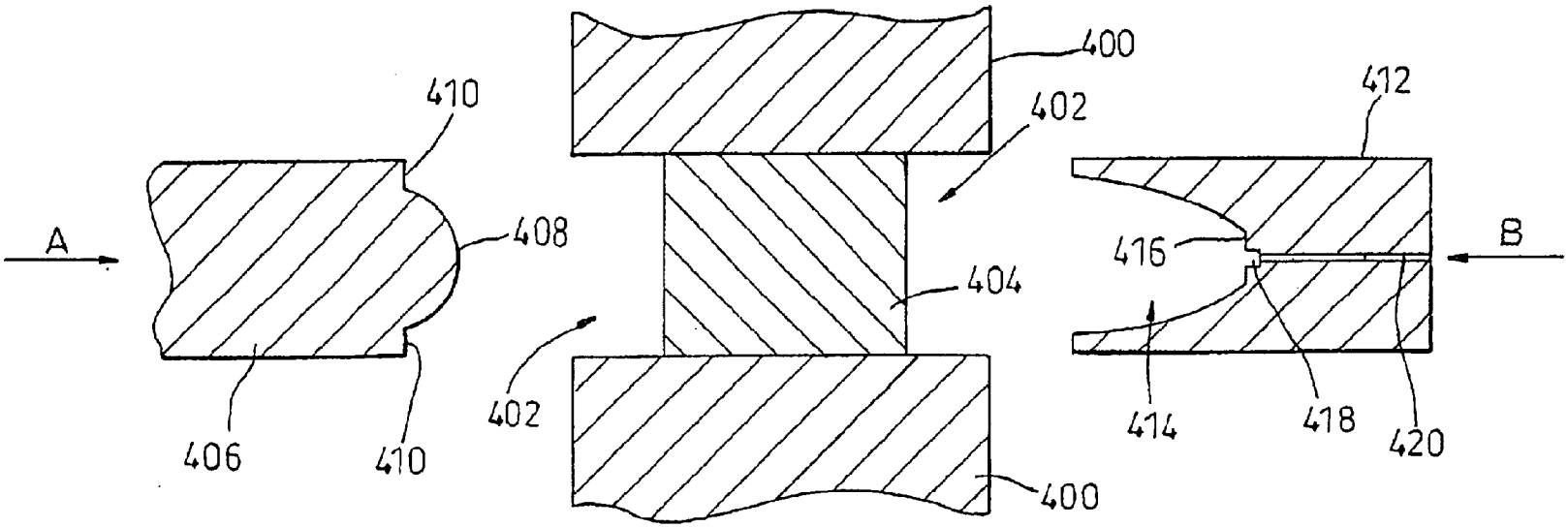
FIG. 5 shows a die for the manufacture of a bullet of the invention.

In FIG. 5 is illustrated an apparatus for the manufacture of a bullet of the invention.

The apparatus has a fixed die portion 400 defining a cylindrical moulding cavity 402 in which is shown a plug 404 of lead to be formed into a bullet of the invention. A first punch part 406 of cylindrical shape has an external diameter of size just to fit within cavity 402. Part 406 has a domed end 408 extending from an annular land 410, the land and domed end corresponding to the desired cavitied rear face of a bullet. A second punch part 412 is also of cylindrical shape and of external diameter just to fit into cavity 402 from the end opposite to that into which part 406 is to be fitted. Part 412 has a central cavity 414 of tapering curved shape corresponding to the desired curvature of the front portion of a bullet of the invention. At its innermost extent the cavity 414 has a flat portion. 416 to correspond to the flat nose of the bullet and a cylindrical recess 418 centrally disposed in flat portion 416 to form the projection from the flat nose. A sprue hole 420 leads from the recess 418 through the body of part 412 to vent to atmosphere.

When punch parts 406 and 412 are moved in the direction of arrows A and B respectively to enter cavity 402 of die 400, the lead plug 404 is moulded to the desired novel bullet shape. The venting provided from cavity 414 and recess 418 ensures that the lead can completely fill those regions of punch part 412 to provide a satisfactorily formed shape.

What is claimed is:

1. An ammunition cartridge comprising a casing attached to a bullet, the bullet having a body portion of generally cylindrical shape, the body portion having a first end attached to the casing and a second end leading to a tapering curved portion terminating in a flat nose normal to a longitudinal axis of the bullet, the flat nose having a centrally-disposed projection extending forwardly away from the flat nose in the direction of the longitudinal axis, and a reservoir of lubricant provided externally of the bullet on an outer surface of the flat nose around the projection.

2. An ammunition cartridge according to claim 1, wherein the projection is uniformly disposed about the longitudinal axis of the bullet.

3. An ammunition cartridge according to claim 1, wherein the projection is of circular shape in plan.

4. An ammunition cartridge according to claim 3, wherein the projection is of cylindrical shape.

5. An ammunition cartridge according to claim 4, wherein the projection has a flat outer end.

6. An ammunition cartridge according to claim 4, wherein the projection has a domed outer end.

7. An ammunition cartridge according to claim 1, wherein a lubricant coating is provided.

8. An ammunition cartridge according to claim 1, wherein the ammunition cartridge is a .22 ammunition cartridge.

9. An ammunition cartridge according to claim 1, wherein the tapering curved portion is of constant radius.

10. A method of manufacturing a bullet having a longitudinal axis, the method comprising the steps of:

providing material to form the bullet, shaping the material to form the bullet with a cylindrical body portion leading to a tapering curved portion terminating in a flat nose at a front end of the bullet, and a centrally disposed projection extending forwardly away from the flat nose in the direction of the longitudinal axis of the bullet, and forming a reservoir of lubricant externally of the bullet on an outer surface of the nose around the projection.

* * * * *